US007393061B2

(12) United States Patent
Hesse et al.

(10) Patent No.: US 7,393,061 B2
(45) Date of Patent: Jul. 1, 2008

(54) COAL PLOW CUTTER

(75) Inventors: Norbert Hesse, Bochum (DE); Adam Klabisch, Dortmund (DE); Uwe Tillessen, Kamen (DE); Klaus Duhnke, Bochum (DE); Gerhard Siepenkort, Lünen (DE)

(73) Assignee: DBT GmbH (DE)

( * ) Notice: Subject to any disclaimer, the term of this patent is extended or adjusted under 35 U.S.C. 154(b) by 0 days.

(21) Appl. No.: 11/102,386

(22) Filed: Apr. 7, 2005

(65) Prior Publication Data

US 2006/0087169 A1 Apr. 27, 2006

(30) Foreign Application Priority Data

Apr. 15, 2004 (DE) ..... 20 2004 005 920 U

(51) Int. Cl.
*E21C 35/18* (2006.01)

(52) U.S. Cl. ..... 299/112 R

(58) Field of Classification Search ..... 299/108–109, 299/34.04, 113, 112 T, 112 R; 175/420.1
See application file for complete search history.

(56) References Cited

U.S. PATENT DOCUMENTS 4,674,802 A * 6/1987 McKenna et al. ..... 299/112 R
4,917,196 A * 4/1990 Stiffler et al. ..... 175/385
5,143,163 A * 9/1992 Stiffler et al. ..... 175/385

FOREIGN PATENT DOCUMENTS

DE 295 037 43 U1 3/1995
DE 29503743 * 7/1995

* cited by examiner

*Primary Examiner*—Sunil Singh
(74) *Attorney, Agent, or Firm*—Baker & McKenzie LLP

(57) ABSTRACT

A plow cutter having a cutter foot that includes a cutter shank and a cutter head, the plow cutter including at least one face cutting edge, a plurality of wear-resistant face cutting edge pins each anchored in a respective recess located in the face cutting edge, at least one of the plurality being located on either side of a center plane of the cutter head, and a floor blade that includes at least one wear-resistant floor blade pin. Each of the plurality of the face cutting edge pins and the floor blade pin is made of a highly wear-resistant material, and has a conical pin head and a curved dome shape external surface.

11 Claims, 1 Drawing Sheet

COAL PLOW CUTTER

CROSS-REFERENCE TO RELATED APPLICATIONS

This application claims priority to German Application No. 20 2004 005 920.7 filed on Apr. 15, 2004.

BACKGROUND OF THE INVENTION

This invention relates to a coal plow cutter with a cutter foot that forms a cutter shank and a cutter head that comprises at least one coal face cutting edge, whereby the coal face cutting edge has at least one pin as a cutting body that is made of highly wear-resistant material and is anchored in a recess in the cutter head.

The closest prior art is the plow cutter described in DE 295 037 43 U1 with a floor blade and a coal face cutting blade, in which the floor blade is formed from a cutting insert that is made of highly wear-resistance material such as hard carbide in particular, and the coal face cutting blade is formed from highly wear-resistant pins that are inserted in borings. In the coal plow cutter of the prior art, as a result of the presence of the pins on the coal face cutting blade, during operation of the plow the solder seams of the cutting insert, which has a large surface area, are subjected to lower stresses on the floor cutting blade, as a result of which the useful life of the coal plow cutter is improved. The purpose of soldering the pins is to prevent the erosion of the support material, and the purpose of the inserted pins is to prevent damage to the cutting edges even when the plow is moving in reverse.

The object of the invention is to improve the useful life of coal plow cutters of the prior art using economical measures, even under the increasing loads that result from higher rates of face advance or greater cutting depths.

The invention teaches that the pin has a conical pin head, whereby the external surface of the cone-shaped pin head has a curved dome shape, and/or the cutter has a floor blade that comprises at least one pin that is made of highly wear-resistant material. The conical pins with a curved, dome-shaped external surface that are provided in accordance with one aspect of the invention not only have a better cutting action than the pins with rounded pin heads that are used in the prior art, but they also result in fewer blowouts on the solid cutting insert made of hard carbide that may optionally be present on the front side.

In the preferred configuration, both the pins located on the floor blade as well as the pins located on the coal face blade have a conical pin head with a curved, dome-shaped external surface. The pins can be glued, clamped or preferably soldered into the recesses that preferably consist of blind holes in the plow head.

In the particularly preferred configuration, on the upper side of the cutter head farther from the cutter foot there is at least one pin that has a conical pin head with a conical dome-shaped external surface. This pin head that is located on the upper side results in an increased cutting capacity of the cutter and simultaneously protects the surface of the plow head and additional cutting heads or cutting inserts when the plow is moving in reverse. During the reverse movement, the plow is moved along the working face in the direction opposite to the cutting direction for the respective coal plow cutter. The pin on the upper side of the cutter head can in particular form a component of the floor blade, and can project with its pin tips beyond the upper edge of a frontal cutting body of the floor blade, so that during operation of the plow, the stresses on the frontal cutting bodies in the main cutting zone are reduced.

The frontal cutting body can be a cutting insert, for example, whereby the cutting insert can have larger dimensions than configurations of the prior art because the forces that are exerted on the cutting insert are lower. The tip of the pin head of the pin that is associated with the floor blade projects on the upper side beyond the upper edge of the cutting insert preferably by a minimum of 1 mm and a maximum of approximately 2 mm. In an alternative configuration, the frontal cutting body can also consist of an additional pin, the pin head of which then preferably has a larger diameter than the pin heads of the other pins that are made of highly wear-resistant material.

In the particularly preferred configuration, the pin heads of the pins on the upper side of the cutter head are oriented diagonally relative to the direction of movement or cutting of the plow, whereby the external surface of the respective pin head that points in the cutting direction of the pins on the upper side is inclined more steeply with respect to the cutting direction than the external surface on its rear side. On account of the inclined position of the pins, a greater cutting capacity is achieved, and simultaneously a more favorable application and introduction of the working forces into the cutter head and the anchoring of the pins. On account of the greater forces that can absorbed with the inclined position of the pins on the upper side, the forces that are introduced into a frontal cutting insert are also further reduced.

In one configuration of a coal plow cutter that preferably forms a bottom blade, the upper side of the cutter head can be bordered by two essentially flat arms that run toward each other at an angle on an apex line, whereby the pin or pins on the upper side is/are located on the apex line. On a symmetrical cutter, the apex line hereby runs in the center, and on an asymmetrical cutter it runs eccentrically. Also advantageously, in one configuration, the cutting insert that forms the frontal cutting bodies can be realized in a triangular shape, whereby the arms on both sides of the cutting insert and/or behind the cutting insert in the cutting direction are provided with pins that are realized as taught by the invention to reduce the loads exerted on the cutting insert. The borings in the cutter head into which these pins are inserted are preferably inclined by 45° relative to the center plane of the cutter foot. The cutting insert can in particular be soldered with wire mesh into a countersunk edge in the cutter foot. The pins are preferably made of hard carbide and the cutter bodies with the cutter head and cutter shank are realized in one piece from a forging.

BRIEF DESCRIPTION OF THE SEVERAL VIEWS OF THE DRAWINGS

Additional advantages and configurations of the invention are described in greater detail below on the basis of the exemplary embodiments that are illustrated schematically in the accompanying drawings. In the drawings.

DETAILED DESCRIPTION OP THE INVENTION

Figure 1:
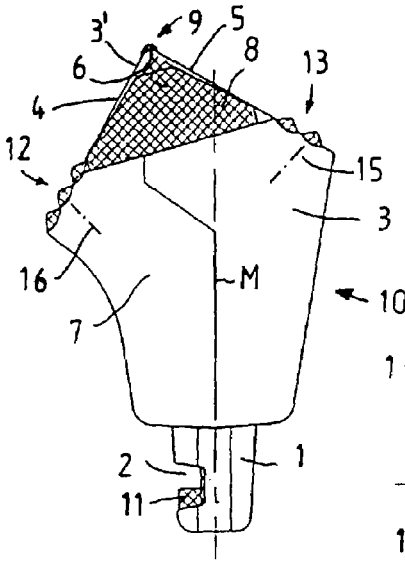
FIG. 1 shows a coal plow cutter as taught by the invention in a head-on view of a first exemplary embodiment.
Figure 2:
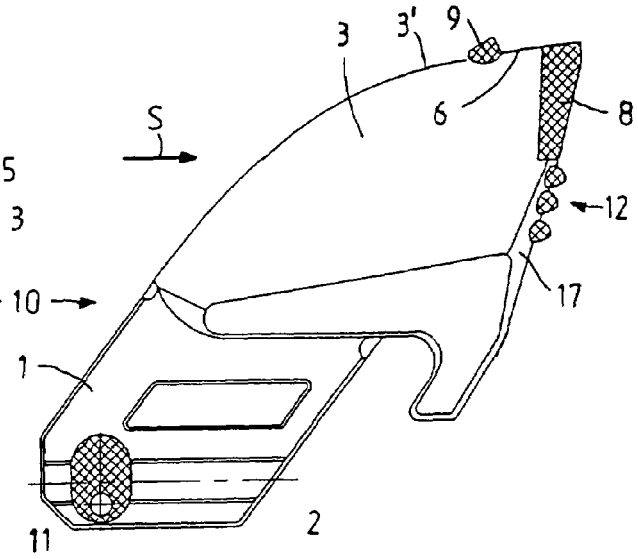
FIG. 2 is a side view of the cutter illustrated in FIG. 1.

In FIGS. 1 and 2, a coal plow cutter that is designated 10 overall is shown by way of example in the form of an asymmetrical bottom blade1 Above a cutter foot 1, which is realized in the toxin of a cutter shank, and into which into an additional cutter holder (not shown) can be inserted, the forged base body of the cutter 10 has a cutter head 3 such that a locking pin penetrates a front and back wall in the cutter holder through an open-edge transverse groove 2 in the cutter foot 1 and secures the cutter 10 in the holder against falling out. The locking pin is secured against coming loose by means of a deformable insert 11, which sits in a recess in the vicinity of the transverse groove 2. The upper side 3' of the cutter head 3 farther from the cutter foot 1 is bordered by two arms 4, 5 that run approximately at a right angle to each other. The two flat arms 4, 5 meet at the apex line 6, which in this case is offset to the left relative to the center plane M of the cutter foot 1. Because the cutter 10 forms a bottom blade, its upper side 3' points toward the floor in operation when the blade 10 is not mounted on the plow (not shown). The arm 4 then simultaneously forms the arm that faces the coal face, whereby the arm 4 is bent by 30° with respect to the center plane M and the arm 5 by 60° with respect to the center plane M. The bottom blade 10 has, on the surface that forms the front side 7 when the coal plow is moving in the cutting direction (Arrow S), a solid hard carbide plate 8 that has an approximately triangular contour which is soldered into a countersunk edge in the blade head and is backed by a wire mesh. The hard carbide plate B extends to both arms 4, 5 and to beyond the apes line 6. On the upper side 3' of the blade head 3, a hard carbide pin 9 is located offset to the rear viewed in the cutting direction S and lying on the apex line 6, whereby the pin head that projects beyond the upper side 3' is realized in a conical shape and has a curved, dome-shaped external surface. The hard carbide pin 9 forms a component of the bottom blade 10 and the tip of the pin head projects beyond the upper edge of the cutting insert 8. Further, on both sides of the cutting insert 8, on a beveled zone 17 of the front side 7, there are a plurality of hard carbide pins 12 and 13, whereby the hard carbide pins 12, of which there are three in this case, form a component of the coal face cutting edge, while the two hard carbide pins 13, together with the cutting insert 8 and the pin 9 on the upper side 3', form the floor cutting edge. All the hard carbide pins 12 and 13 also have conical in heads with a. curved, dome-shaped external surface. The borings into which the pins 12 and 13 are inserted and in which they are soldered run at an angle of 45° in relation to the center axis M of the blade foot, as indicated by the pin axes 15 and 16.

Figure 3:
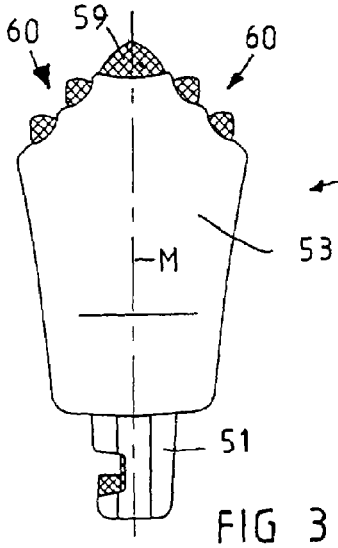
FIG. 3 is a head-on view of a second exemplary embodiment of a coal plow cutter as taught by the invention.
Figure 4:
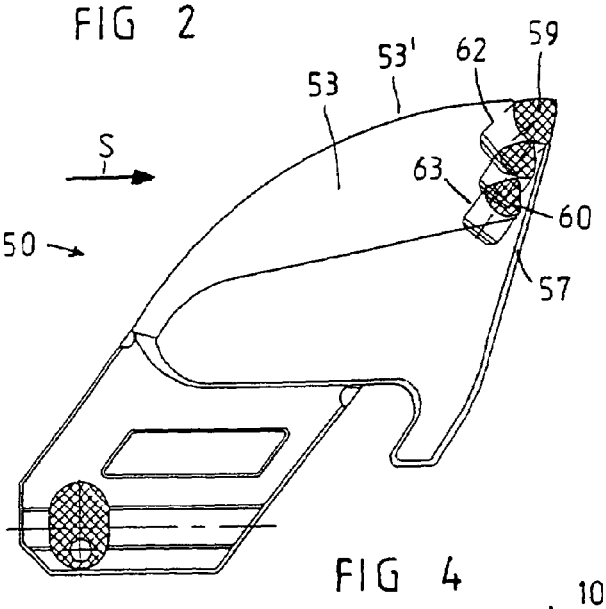
FIG. 4 is a side view of the cutter illustrated in FIG. 3.

FIGS. 3 and 4 show a coal plow cutter 50 which can be used both on a roof blade carrier of a coal plow as well as on other cutter supports of a coal plow. The coal plow cutter 50 again has a forged blade body with a blade foot 51 and blade head 53, although in this case there is a first hard carbide pin 59 located in the center on the transition from the front side 7 to the upper side 53, and there are two additional hard carbide pins 60 on each side of the top center hard carbide pin 59. The arrangement of the cutter pins 60 and of the central hard carbide pin 59 which has a larger diameter than the other two is symmetrical with respect to the center plane M, and all the hard carbide pins 59, 60 have conical pin heads with a curved, dome-shaped external surface. The cutter 50 has only coal face cutting edges. FIG. 4 shows that the individual hard carbide pins 59 and 60 are located in borings 62 and 63 respectively. Furthermore, as shown particularly clearly in FIG. 4, the center axes of the borings 62, 63 are inclined with respect to the cutting direction S of the coal plow, whereby the center axes also run in particular at an angle of approximately 45° with respect to the center plane M of the cutter foot 51.

Figure 5:
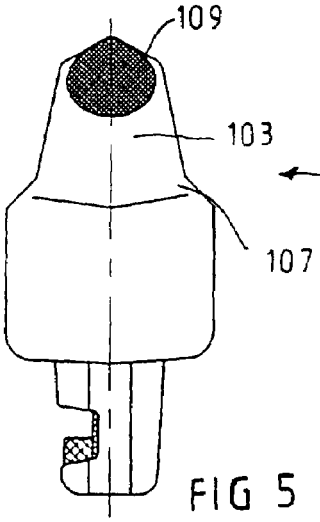
FIG. 5 is a head-on view of a coal plow cutter in a third exemplary embodiment of the invention.
Figure 6:
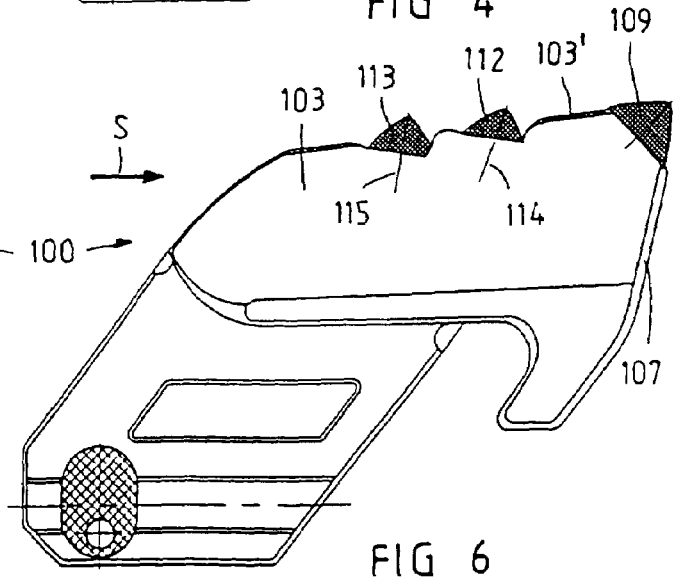
FIG. 6 is a side view of the cutter illustrated in FIG. 5.

FIGS. 5 and 6 show a third exemplary embodiment of a coal plow 100 as taught by the invention, which is also realized symmetrically and does not have a floor blade. On the front side 107 of the cutter head 103, at the transition to the upper side 103' of the cutter head, there is a central hard carbide pin 109. Behind the frontal hard carbide pin 109 in the cutting direction are two additional, smaller-diameter hard carbide pins 112 and 113. All of the hard carbide pins 109, 112, 113 are components of the coal face cutting edge, whereby the axis 114 of the hard carbide pin 112 is inclined toward the rear at an angle of approximately 70° with respect to the cutting direction S and the axis 115 of the pin 113 is inclined toward the rear at an angle of approximately 80° with respect to the cutting axis. All of the hard carbide pins 109, 112, 113 comprise conical pin heads that have a curved, dome-shaped external surface.

A technician skilled in the art will be able to devise numerous potential modifications to the device described above that lie within the scope of protection of the dependent claims. The number of pins that are located on the flanks of a frontal cutting insert can vary. Instead of pins on the flanks of the cutting insert, one or more pins can also be located behind the cutting insert.

The invention claimed is:

1. A plow cutter having a cutter foot and a cutter head, the plow cutter comprising:

at least one face cutting edge;

a plurality of wear-resistant edge pins each anchored in a respective recess on a first side of a center plane of the cutter foot;

a second plurality of wear-resistant edge pins each anchored in a respective recess on a second side of the center plane of the cutter foot; and a floor blade that includes at least one wear-resistant floor blade pin, wherein the center plane of the cutter foot is substantially perpendicular to a cutting direction of the plow cutter;

a central axis of each of the plurality of edge pins is oriented at an angle with respect to the center plane of the cutter foot; and each of the edge pins and the at least one floor blade pin has a conical pin head and a curved dome-shaped external surface.

2. The plow cutter of claim 1, wherein at least one of the edge pins is soldered into the respective recess in the cutter head.

3. The plow cutter of claim 1, wherein the at least one floor blade pin is located on an upper side of the cutter head opposite the cutter foot.

4. The plow cutter of claim 1, wherein the at least one floor blade pin is located on an upper side of the cutter head; and the head of the at least one floor blade pin projects beyond a frontal cutting body of the floor blade.

5. The plow cutter of claim 4, wherein the frontal cutting body is a cutting insert.

6. The plow cutter of claim 4, wherein the frontal cutting body includes a frontal cutting body pin; and a diameter of a head of the frontal cutting body pin is larger than a diameter of the head of each of the edge pins.

7. The plow cutter of claim 4, wherein the pin head of the at least one floor blade pin is oriented diagonally on the upper side of the cutter head relative to the cutting direction; and a surface of the pin head that points in the cutting direction is inclined at a steeper angle with respect to the cutting direction than a surface of the pin head that points in a direction opposite to the cutting direction.

8. The plow cutter of claim 1, wherein an upper side of the cutter head is bordered by at least two arms that run diagonally toward each other and that meet on an apex line; and the at least one floor blade pin is located on the upper side and on the apex line.

9. The plow cutter of claim 8, wherein a cutting insert that forms a frontal cutting body is formed in a triangular shape;

at least one of the edge pins is located on at least one of the arms; and the edge pins are located on either side of the cutting insert with respect to the center plane or behind the cutting insert with respect to the cutting direction.

10. The plow cutter of claim 9, wherein the edge pins located on either side of the cutting insert are inserted in respective recesses in the cutter head; and center axes of the recesses are oriented at an angle with respect to the center plane.

11. The plow cutter of claim 1, wherein the first plurality of wear-resistant edge pins includes at least one face cutting edge pin located in the face cutting edge.

* * * * *